US007423738B2

(12) United States Patent
De Toni et al.

(10) Patent No.: US 7,423,738 B2
(45) Date of Patent: Sep. 9, 2008

(54) INSPECTING SYSTEM FOR SECURITY DOCUMENTS

(75) Inventors: Giovanni De Toni, Milan (IT); Renzo Lisei, Milan (IT); Maurizio Ripamonti, Sergate (IT); Roberto Salgari, Basiglio (IT)

(73) Assignees: Officina Riparazioni Macchine Grafiche-O.R.M.A.G.-S.p.A., Novegro di Segrate (Milano) (IT); Parvis Systems and Services S.R.L., Milan (IT)

( * ) Notice: Subject to any disclaimer, the term of this patent is extended or adjusted under 35 U.S.C. 154(b) by 132 days.

(21) Appl. No.: 10/528,200

(22) PCT Filed: Sep. 17, 2002

(86) PCT No.: PCT/IT02/00594

§ 371 (c)(1),
(2), (4) Date: Oct. 28, 2005

(87) PCT Pub. No.: WO2004/027719

PCT Pub. Date: Apr. 1, 2004

(65) Prior Publication Data

US 2006/0098840 A1 May 11, 2006

(51) Int. Cl.
*G07D 7/12* (2006.01)

(52) U.S. Cl. ..... 356/71; 356/239.1; 250/461.1

(58) Field of Classification Search ..... 356/71; 250/461.1

See application file for complete search history.

(56) References Cited

U.S. PATENT DOCUMENTS

| | | | | | |
|---|---|---|---|---|---|
| 2,567,049 | A | * | 9/1951 | Belluche | 33/21.1 |
| 2,731,621 | A | * | 1/1956 | Sontheimer | 209/534 |
| 3,860,118 | A | | 1/1975 | James et al. | |
| 4,296,326 | A | * | 10/1981 | Haslop et al. | 283/70 |
| 5,110,212 | A | | 5/1992 | Gabura | |
| 5,280,333 | A | | 1/1994 | Wunderer | |
| 5,368,148 | A | | 11/1994 | Orlandini | |
| 5,498,879 | A | | 3/1996 | De Man | |
| 5,720,376 | A | * | 2/1998 | Polidoro et al. | 194/207 |
| 7,266,231 | B2 | * | 9/2007 | Christophersen et al. | 382/137 |

FOREIGN PATENT DOCUMENTS

| | | |
|---|---|---|
| DE | 1953542 | 5/1971 |
| DE | 10000030 | 7/2001 |
| EP | 0581102 | 2/1994 |
| FR | 2492349 | 4/1982 |
| GB | 1433422 | 4/1976 |
| WO | 9731340 | 8/1997 |

* cited by examiner

*Primary Examiner*—L. G. Lauchman
*Assistant Examiner*—Rebecca C Slomski
(74) *Attorney, Agent, or Firm*—Young & Thompson

(57) ABSTRACT

An inspecting system for security documents is disclosed, wherein a rotating cylinder provided with transparent sectors is apt to transport the document past an image acquiring device, and in which a transparency inspecting device is placed partially inside and partially outside the cylinder so that the electromagnetic inspecting beam is intercepted by the documents held lying onto the transparent sectors. Further, the inspecting system is provided with shading elements, in the optical pattern, apt to define a cone of shade only in correspondence of sensitive elements of a camera.

15 Claims, 8 Drawing Sheets

INSPECTING SYSTEM FOR SECURITY DOCUMENTS

TECHNICAL FIELD OF THE INVENTION

The present invention relates to an inspecting system for security documents, such as banknotes and value sheets. In particular, it relates to a security documents rotating transport system to be installed into an improved inspecting station.

BACKGROUND OF THE INVENTION

As known, in many apparatus for manufacturing and handling security documents, such as banknotes, value sheets and the like, at least one inspecting station is provided to test the quality, genuineness and other features of such security documents.

The inspection is performed by grabbing the image of the document—which is suitably illuminated while passing through the inspecting station—processing it with more or less sophisticated analogical or digital methods and comparing it to previously generated and configured reference patterns.

The first basic feature required in order to obtain inspecting stations of suitable quality concerns the evenness of the security document-transporting movement.

So far, in known systems, the document to be inspected was made to advance past the inspecting device with a straight-away or curvilinear motion and with various techniques. However, the results obtained thus far have not been completely satisfying.

DE1953542 discloses an inspection system where an illuminator device is composed of fluorescent plates having difference fight lobes apt to shift the maximum brightness some distance away from the exit edge of said fluorescent plates. U.S. Pat. No. 5,498,879 discloses a device which provides uniform illumination in an apparatus for testing notes, in which the device is optically diffractive.

In order to understand the difficulty of the technical task undertaken herewith, it should be considered that, in the case of banknotes, for example, the document is a very thin (about 0.1 mm) 800×700 mm sheet that is transported at a speed of about 3 m/sec: this implies inevitable sheet vibrations and oscillations—especially generated by aerodynamic forces—which, if not correctly controlled, may completely compromise the reliability of the data acquired during the test.

Therefore, although prior art systems have reached acceptable quality standards, at the cost, in some cases, of adopting complex adjusting and control systems, there is still the need to reach a higher level of movement evenness, without compromising on the quality or excessively increasing the manufacturing difficulty and related costs.

Another feature, which, as may be easily guessed, affects the quality of the inspecting operation results, concerns the actual acquiring system.

Normally, the document image is acquired through electronic cameras; in particular line scan cameras performing a line-by-line scanning of each document.

Image acquisition may be performed basically using two techniques: by reflection or by transparency, depending on which security document feature is to be scanned and tested.

In a reflection system, the camera and the light source are placed on the same side relative to the document to be inspected, as shown in FIG. 1.

As it can be seen in the figure, a light source 1, through a wave-guide system (for example fibre optics) 2 and a collimation device 3, projects a bright band 1*a* focussed onto a document 4 to be inspected (also called target). On the same side of the lighting system there is also an acquisition camera 5, "reading" the light reflected by the document in order to transform it into an analogical or digital signal to be analysed with known techniques.

By varying the relative angle of the camera and of the lighting system relative to the document 4, it is possible to acquire images in different conditions, i.e. with specularly reflected light or with diffused light.

This arrangement is used to inspect features on the recto and verso of a document, such as a banknote.

In a transmitted light system, on the other hand, the camera and the lighting device are placed substantially opposite to each other relative to the document to be inspected, the latter being made to pass between the former. This arrangement is used to transparency-inspect specific features, such as watermarks, security threads and so on.

Some of the drawbacks afflicting the prior art systems are indicated below.

The cameras commonly used in this field are black and white or RGB line scan cameras, requiring a simple line of light, of sufficient intensity and quality, to be generated, in order to allow a correct acquisition. The quantity and quality of the light is a critical factor in this type of appliances, due to the high document transportation speed and thus the short exposure times: with a 0.25 ms/pixel resolution camera, at the above said typical speeds, the exposure time allowed is shorter than 25 ms/pixel line.

The line of light is generated by a suitable (halogen, arc, metal halide, etc.) lamp, which is directed towards a circular-shaped fibre optic input beam, by means of an elliptical reflecting mirror. At the opposite end of the beam, the fibres output is disposed so as to generate a line of light (for example, a 1.6×120 mm line). The light generated by the fibres diverges at a specific angle and is then collected by a system of lenses (usually cylindrical) and focussed onto the target within the camera field of vision.

The light that hits the target, however, if accurately measured with suitable instruments, is somewhat irregular and uneven, especially at the boundaries of the illuminated area.

In fact, it must be considered that each point in the field of vision receives the light from a certain portion of the illuminator (a segment measuring a few centimeters), because there is a certain angle of light source emission (in the case of a fibre optic endings, this angle is 60°). On the boundaries of the illuminated area the quantity of received light decreases rapidly, corrupting the uniformity of the luminous profile; if an illuminator were available which were much longer (ideally endless) than the usable length of the camera field of vision, this problem would not arise: however, this solution is not often applicable.

Beside these generic problems, transparency inspection suffers from another drawback. In fact, when no elements are interposed between the camera and the lighting system—which thing occurs, for instance, in the lapse between one document and the next, at the document edges or with partially transparent documents—the illuminator light hits the camera directly, causing a so-called blooming effect. The camera sensitive elements, in these conditions, exceed their saturation threshold and, for a short subsequent transient (depending on the response times typical of the acquiring electronics), the camera is no longer able to correctly acquire other images.

In order to solve the blooming problem, alternative arrangements have been proposed. For instance, GB2311130 teaches to arrange the optical axis of the camera at a certain angle relative to the illuminator axis. However, this arrangement does not allow reliable detection of potential holes in the document. In fact, the light, which normally focuses, onto the document surface, in the presence of a hole cannot be read by the camera, which reads a black background instead, not being able to tell a hole from a point of the document completely impermeable to the light radiation.

Thus, a first object of the invention is that of providing an inspecting system provided with a transportation device for thin security documents allowing excellent movement evenness.

A further object of the present invention is to provide an inspecting system provided with a lighting and image acquiring system that solves the prior art drawbacks, in particular having a homogeneous luminous profile, over the entire lighting field, and which, in the case of a transparency inspection arrangement, prevents camera blooming without the quality of the document anomalies detection being affected.

SUMMARY OF THE INVENTION

The above-mentioned objects are obtained through a system as described.

That is, according to a first aspect of the invention, an inspecting system comprising a circular movement transportation device, made by a transparent sector transportation cylinder, onto which the security document is held and rotatingly transported, is provided.

According to another aspect of the invention, an inspecting system is provided wherein an illuminating device is disposed on the same axis of a camera, but is provided with a filter, or other direct light shielding means, with suitable features, size and position in order to control the quantity of light directed towards the camera, placed between the light source and the document to be inspected, preferably upstream of the focussing optics; the camera thus "looks" at this filter and is never bloomed by the light source.

According to another aspect of the invention, an inspecting system is provided wherein a lighting system has a linear fibre optic illuminator provided at its side ends with reflecting surfaces.

According to a further aspect, a light homogenising method for the inspecting system is provided, wherein the images of a white reference target are acquired in order to establish which areas of an illuminator target are excessively illuminated, and based on such reference target images a shielding pattern is printed onto a filter to be applied between the light source and the actual target. The pattern is printed using suitable software that receives an input signal of the light profile to be corrected and generates an output signal indicating the pattern to be printed for correcting it.

BRIEF DESCRIPTION OF THE DRAWINGS

Further features and advantages of the system according to the invention will result from the following detailed description of some preferred embodiments thereof; given by way of example and illustrated in the appended drawings, wherein.

DETAILED DESCRIPTION OF SOME PREFERRED EMBODIMENTS

Figure 1:
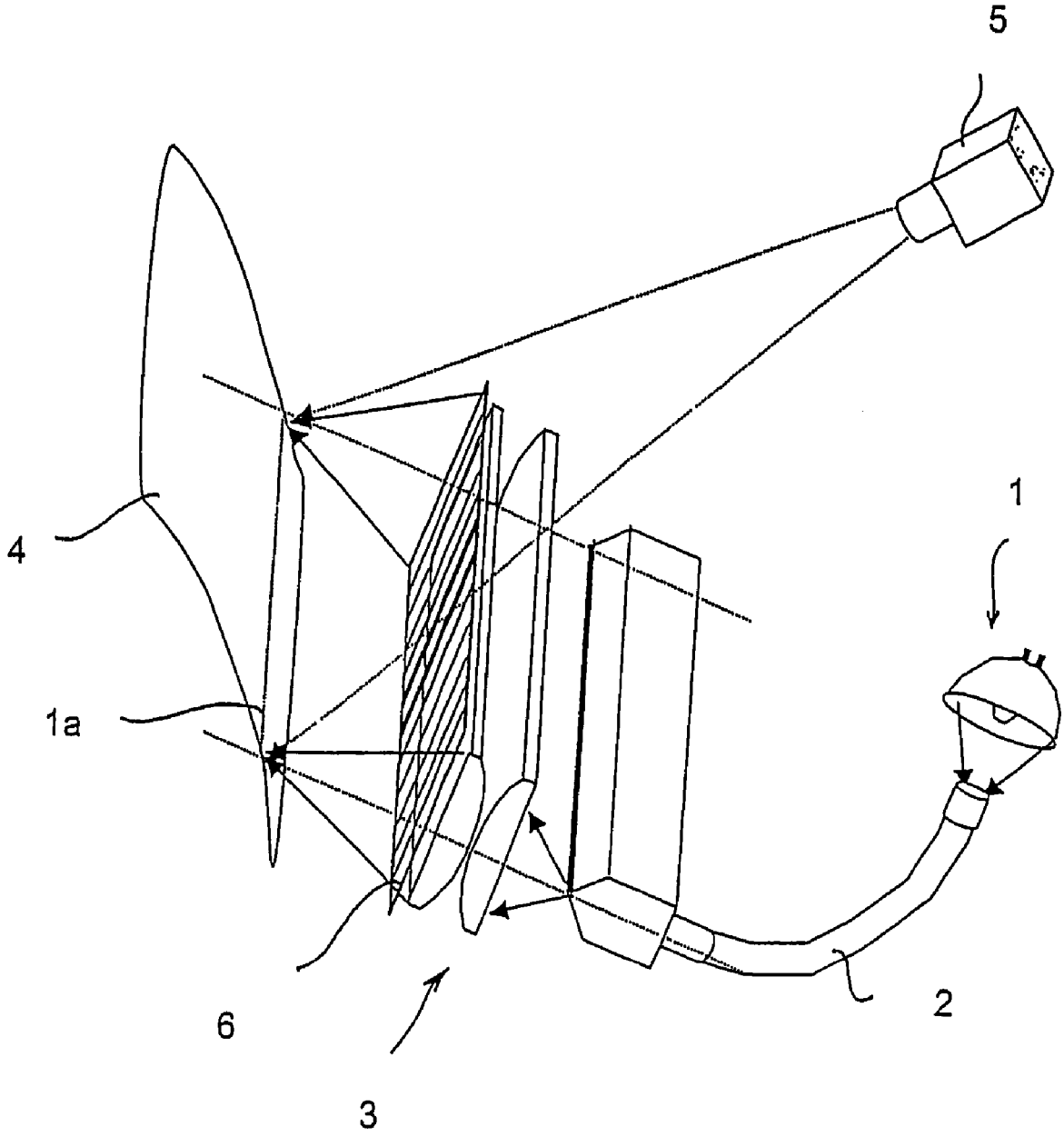
FIG. 1 is a schematic perspective view of a reflection inspecting system.

In the following description, for convenience sake, reference will be made to a banknote sheet, although this shall not be understood as limiting, the invention being applicable to the inspection of any thin security document.

Reference will be first made to the transportation device (FIGS. 5 and 6) and only afterwards to the actual inspecting system.

A cylindrical body 10, transversally rotating into the inspecting system, has a sufficient length for a banknote sheet B to be placed over it. This sheet is taken from a preceding station, in a known way per se, and is held through a gripping system.

According to the invention, the gripping system is made by a holding gripper 11, rotating about a pivotal axis, cooperating with a varyingly movable block 12. The block 12, to work efficiently, is preferably mounted so as to move radially and to have certain circumferential play at the same time. Preferably, the end of block 12 which is to come into contact with the banknote sheet has an elastic surface, for example a rubber covering.

This arrangement allows to lower the bearing point of the gripper 11 onto the block 12 below the nominal rotational diameter of the sheet when passing in front of a calibration device 13.

The calibration device 13 is based on a blade covered at its lower surface in a highly sliding, rectified and finely smoothed special ceramic material (for example, an aluminium and titanium oxide based ceramic).

This way, the calibration device 13 may be held fixed and at a very short distance from the passing sheet, without any risk of it interfering with the gripping system, ensuring that the sheet B, moving at a high speed, is perfectly stabilised and controlled in position just before the inspecting axis a-a'.

Furthermore, according to the invention, the cylinder 10 has transparent sectors 10*a* and 10*b*, onto which the banknote sheet B is to be laid.

The transparent sectors size is such as to allow transparency inspection of a relevant portion of the banknote sheet and are therefore of a material transparent to the frequency/wavelength of the light source used for the inspection.

Although the transparent sectors are preferably removable in order to perform a maintenance operation, a thin transparent protective film (for example, a Mylar® or polyethylene terephthalate PETP film) is provided, apt to protect the transparent sector of the cylinder 10 from potential damage, abrasions and from the dirt (dust, ink stains, etc.) that is inevitably associated to the banknote sheets transportation.

The protective film may be easily removed, once the inspecting system detects a corruption of the transparency qualities thereof.

Inside the transportation cylinder 10 a portion of the actual inspecting system may be placed. A lighting device 3 is preferably housed within the hollow cylinder 10, since its size and its working distance from the document are smaller than those required by a camera 5.

Figure 5:
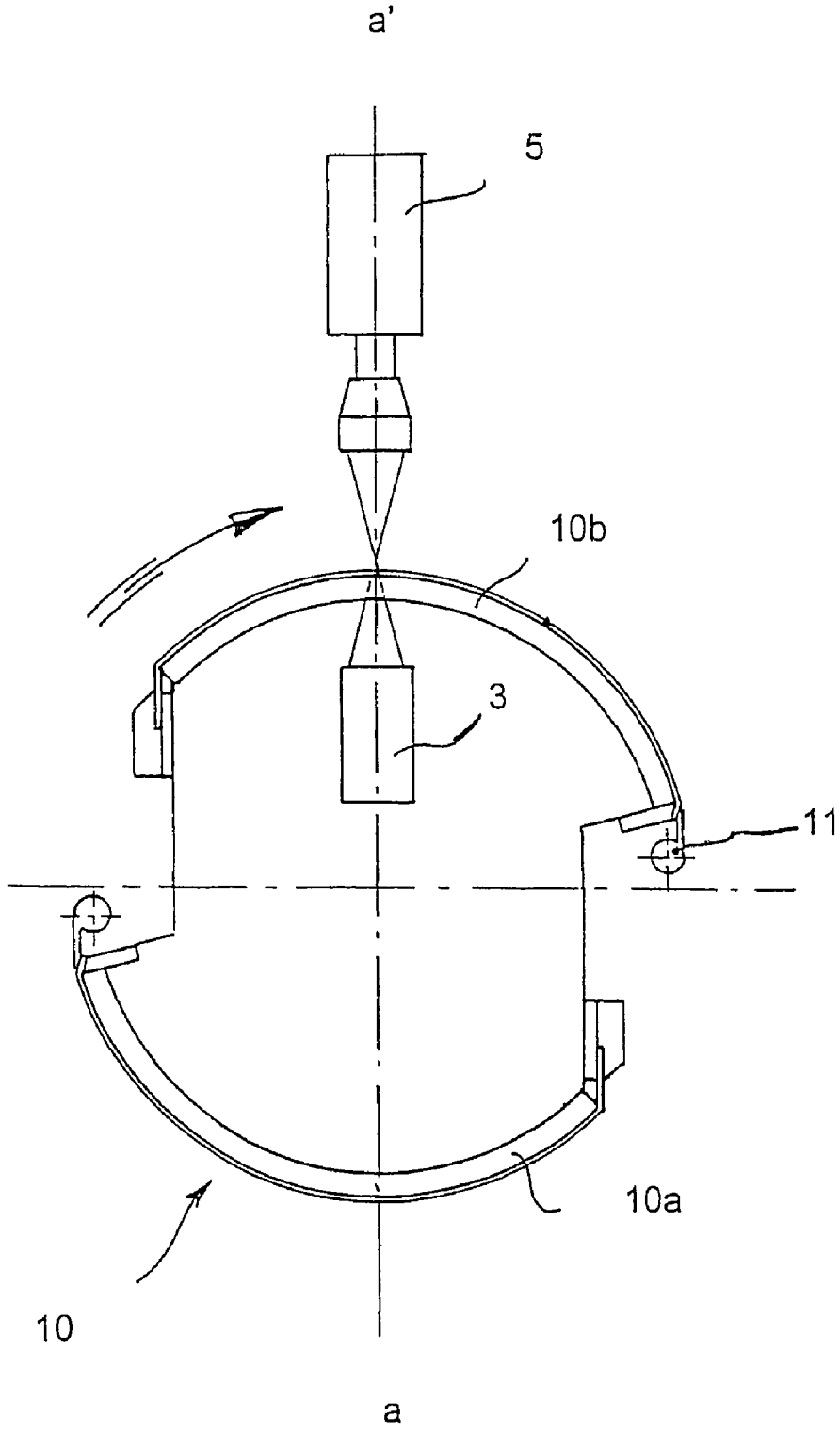
FIG. 5 is a schematic sectional view of the entire inspecting station according to a preferred embodiment of the invention.
Figure 6:
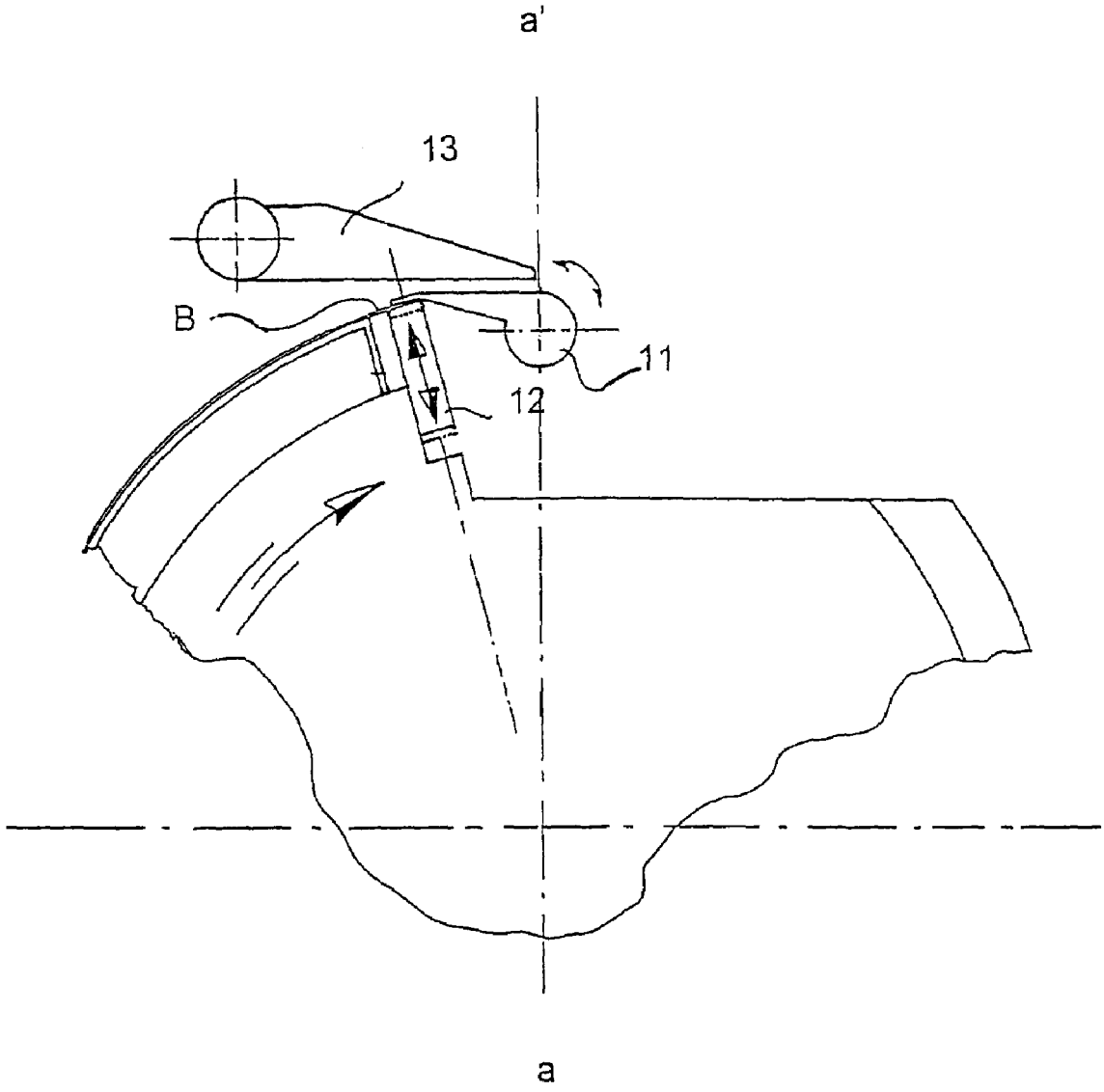
FIG. 6 is an enlarged partial section of the value sheet gripping system in FIG. 5.

According to the invention, the lighting device 3 is mounted so as to project a light beam along the inspecting plane a-a', intercepting at every rotation the transparent sectors 10*a* and 10*b*, onto which the banknote sheet B to be inspected is laid, subsequently hitting an acquisition camera 5 placed onto the same optical axis a-a', but opposite thereto (FIG. 5).

In the following description the inspecting system will be described in detail, with reference to FIGS. 1-4.

The general configuration of the lighting device 3 is substantially similar to that of the prior art.

Figure 4A:
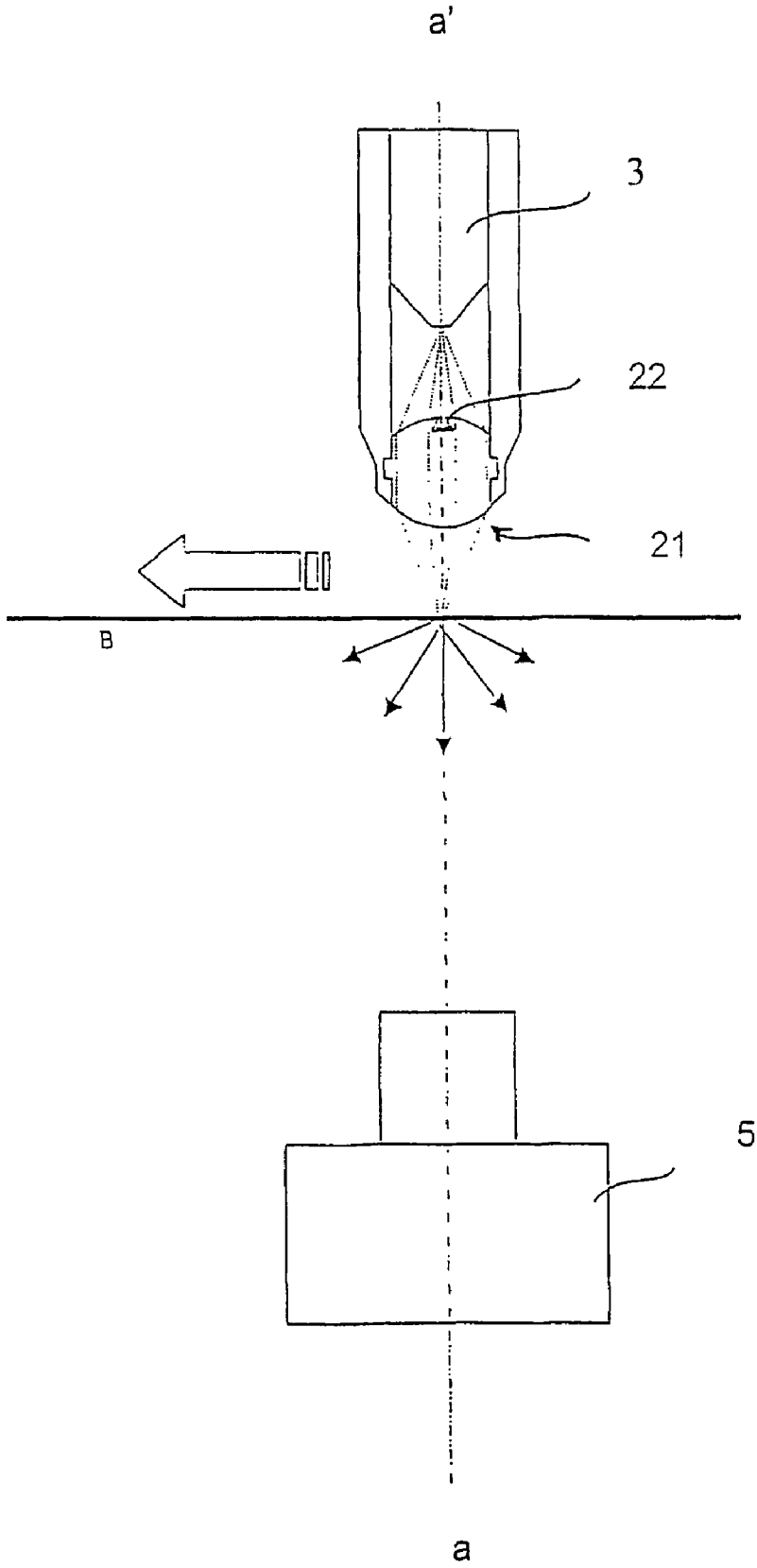
FIG. 4A is a schematic sectional view of a transparency inspecting system according to the invention while a security document is passing.
Figure 4B:
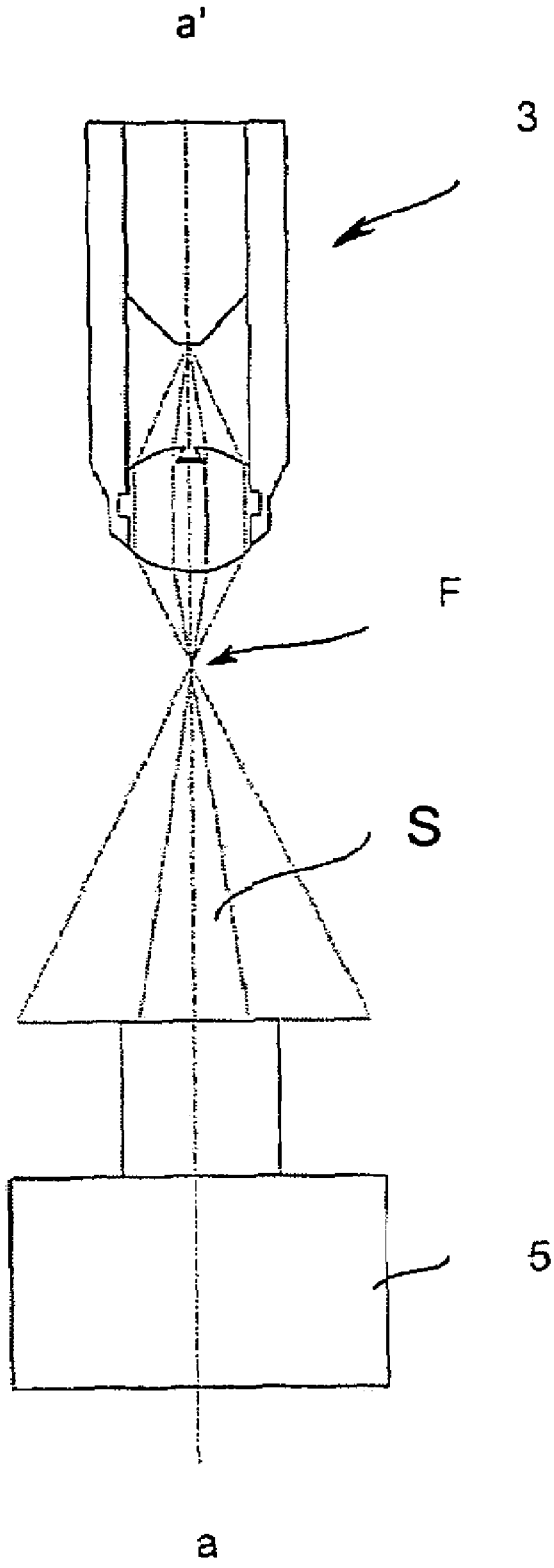
FIG. 4B is a view similar to that of FIG. 4A when no security document is in the inspecting system.
Figure 4C:
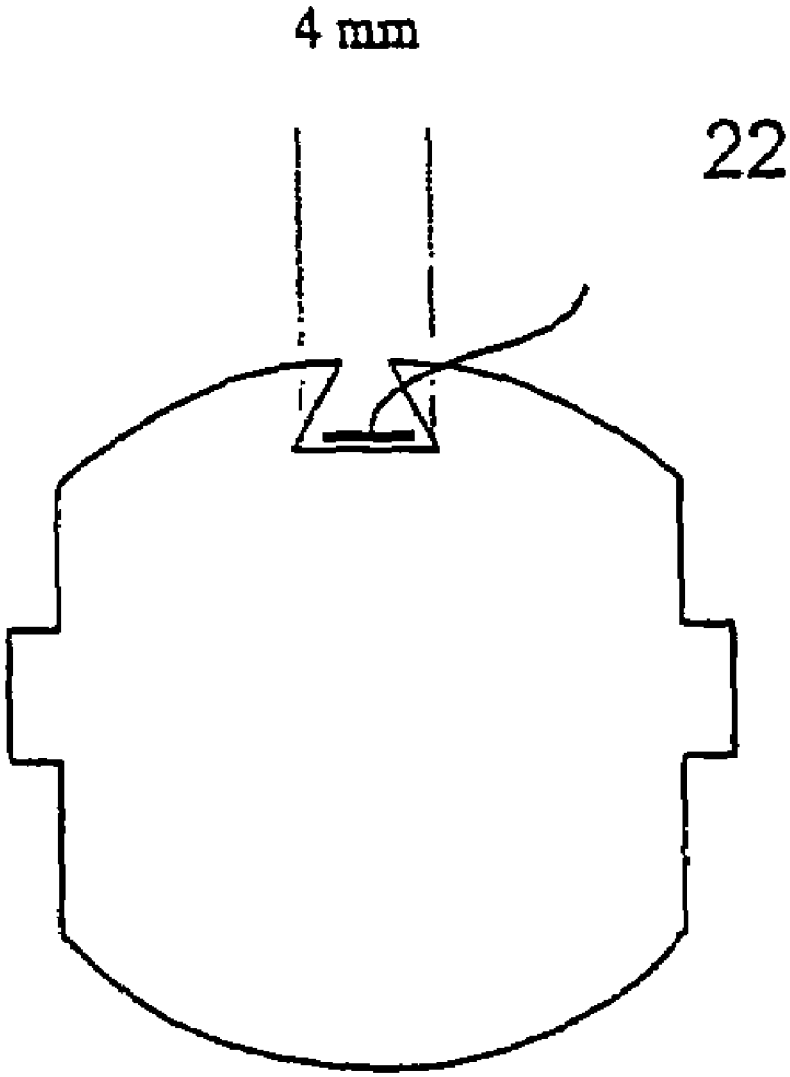
FIG. 4C is an enlarged sectional view of the cylindrical lens illustrated in FIGS. 4A and 4B, with the anti-blooming filter applied.

A set of in-line fibre optics (at least covering as much as the portion of the sheet B to be inspected) receives light at one of its ends from a suitable light source and guides it as a bright band onto a cylindrical lens 21 which focuses it onto a focal point F (FIG. 4B).

The target, namely a banknote sheet B, is to pass by the focal point F.

Furthermore, according to the invention, in the central portion of the cylindrical lens there is a filter 22 of a suitable width and extending over the entire lens length. Preferably, the filter is placed on the side of the lens directed towards the light source.

The filter 22 is in the form of a semitransparent plastic stripe, although other materials, similarly acting as means for regulating light intensity, may be used.

The filter 22 allows to create a cone of shade S, downstream of the focal point F (FIG. 4B), which is to fall in correspondence on the sensitive element of a camera 5 placed opposite the illuminator 3 on the same optical axis a-a'.

Therefore, although the illuminator 3 and the camera 5 lie on exactly the same axis, in the absence of the target B (FIG. 4B), the camera is not bloomed, but simply detects the cone of shade S made by the filter 22.

When, on the other hand, the target B intercepts the light beam at the focal point F (FIG. 4A), a local light diffusion is determined which is correctly beam by the camera 5.

The arrangement according to the invention has the advantage of allowing to control the quantity of light received by the camera, depending on the application type, avoiding blooming. At the same time, it does not affect too much the light intensity hitting the focal point F, where all light power coming from the illuminator 3 concentrates. In fact, the filter 22 size is such as not to over reduce the total light intensity hitting the target.

The Applicant verified that a small, 4 mm wide shielding stripe 22 (with a transmission coefficient of 20%), applied onto a 60 mm wide cylindrical lens, reduces light intensity by only 15%, while completely eliminating the blooming problem.

The filter 22 may also be totally black (i.e. impermeable to the light radiation used), but it is preferably of a semitransparent material such as to let enough light pass for the camera to reach its saturation threshold (about 250 grey levels), without exceeding it. This advantageous feature also allows to sense, during the inspection of a banknote sheet, potential holes in the document, which are detected by the camera as very bright spots.

Other colours and transparency degrees may be used to modify as desired the background light sensed by the camera. In some cases, for instance when inspecting banknotes with fully transparent windows (like some Australian banknotes) the filter 22 ought to be totally black.

Furthermore, in order to provide an even more homogeneous luminous profile of the illuminator—which goes towards improving the quality of the inspection—further features according to the invention are provided.

Figure 2:
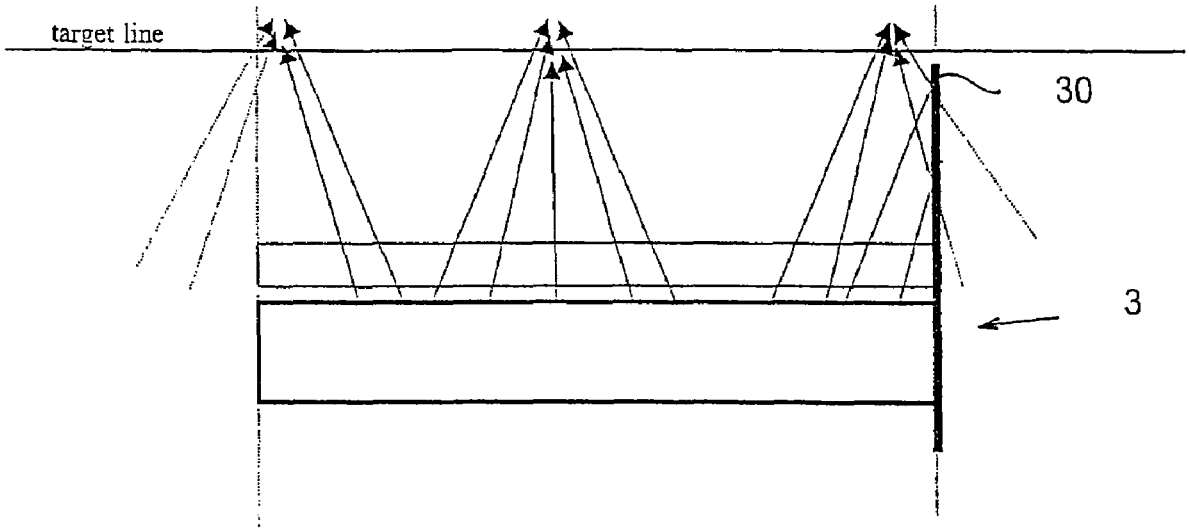
FIG. 2 is a schematic sectional view of a linear illuminator with a reflecting surface applied to only one of its ends, in order to highlight the effect thereof.
Figure 3:
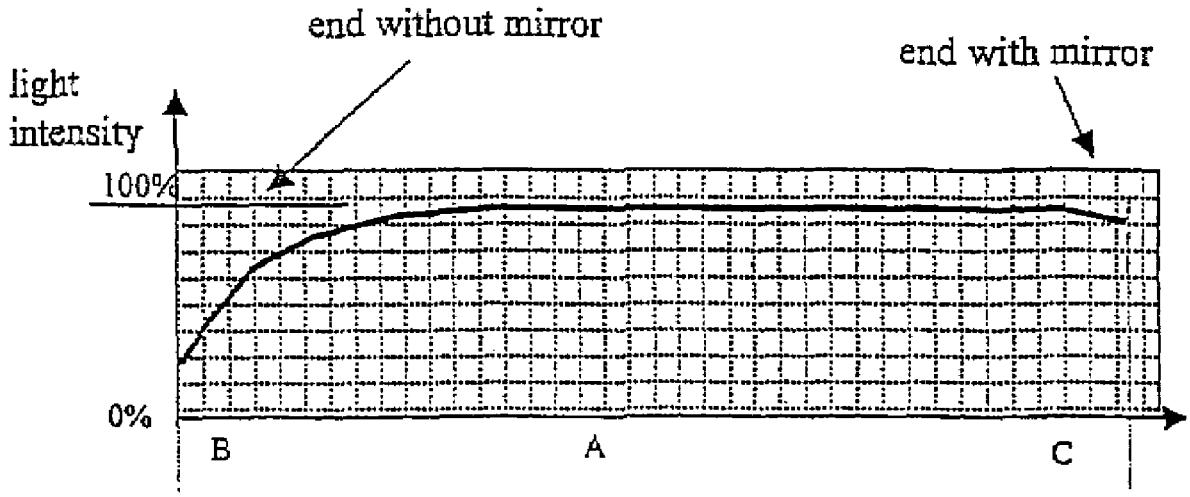
FIG. 3 is a graph showing light intensity along the longitudinal axis of the illuminator in FIG. 2.

With reference to FIGS. 2 and 3, at the edges of the illuminator 3, reflecting surfaces 30 are provided. Such end surfaces 30, externally opaque, have specular surfaces directed towards the illuminator and are apt to collect the incident rays of light (otherwise going to be spread outside the field of interest) and reflect them towards the field of vision, thus simulating a longer illuminator.

This allows the light intensity profile to be made more homogeneous over the entire length of the illuminator. This effect is well rendered by the graph in FIG. 3, showing the light intensity hitting the target line: the right end, provided with the reflecting surface, noticeably has a more even course relative to the left end of the illuminator, lacking the surface 30.

Finally, the outer surface of the focussing lens of the illuminator is provided with a transparent shield onto which a filter arrangement 6 is drawn (FIG. 1).

Such a filter arrangement 6 serves the purpose of diffusing and reducing the quantity of light directed towards specific areas where, in the specific inspecting system installed, excessive light intensity relative to other target areas is detected.

The shielding arrangement may come in different shapes (lines, dots, and the like) and, according to the invention, is automatically generated by a printing device suitably controlled by a computer on the basis of the light reading performed.

The computer acquires, through a known sensor or—better—through the same camera used for the inspection, the light profile of a white target, in the absence of the filter 6, and determines which areas ought to be more shielded. The computer subsequently chooses the filter arrangement 6 by varying the width or density of a plurality of dots or lines transversal to the light source, so as to homogenize the light profile hitting the target to be inspected. For instance, in the case of a filter made of transversal lines with a fixed 4 mm spacing, the programme determines the width of said lines, between 0 and 4 mm with a 0.01 mm pitch, proportionally to the light intensity detected. The filter thus generated is printed onto transparent material, by means of a laser printer, and applied to the outmost lens of the illuminator.

With a greater homogenisation of the incident light, the reading performed by the camera is less affected by disturbing factors, therefore the grabbing and interpreting of the value documents images provide more reliable information.

As can be appreciated, the apparatus and system according to the invention perfectly achieve the objects stated in the introduction.

In particular, the rotating-cylinder transportation system allows to transport the security document with high precision and holding it well adhering to a rigid reference surface (the transparent sectors). The fixed calibration blade, together with the mobile gripping system, further increases the document stability at the inspection axis.

Finally, the anti blooming system, together with the features for homogenising the light hitting the inspection area, allows to have an extremely efficient arrangement with high-quality acquisition results.

It is however intended that the invention is not limited to the above illustrated particular arrangements, which are only non-limiting examples of the scope of the invention, but many alternatives are possible, all of which within the grasp of a person skilled in the art, without departing from the scope of said invention.

The invention claimed is:

1. Inspecting system for thin security documents, comprising:

a transportation device comprised of a rotating cylinder (10) provided with transparent sectors (10*a*, 10*b*) of a size at least equal to a size of a portion of a security document to be inspected;

a transparency inspecting device comprised of i) an image acquiring device, ii) an illuminating device (3), and iii) an electromagnetic inspecting beam arranged between the image acquiring device and the illuminating device;

the transportation device comprising elements to transport said security document past the image acquiring device, wherein, said transparency inspecting device is placed partially inside and partially outside the cylinder so that the electromagnetic inspecting beam is intercepted by said security document held lying onto said transparent sectors, said transportation cylinder comprises a gripping system for said security document, said gripping system having a pivoting gripping element (11) cooperating with at least a radially movable block (12), and the gripping point of the security document is able to be lowered relative to the nominal rotational diameter thereof so as not to interfere with calibration blades (13) fixedly placed in proximity of the inspection axis and strictly adjacent to said rotating cylinder.

2. Inspecting system as in claim 1, wherein said transparent sectors are covered, on the security document bearing side, by a thin removable transparent protective layer.

3. Inspecting system as in claim 1, wherein, an optical path is defined between the illuminating device (3) and an acquisition camera, the acquisition camera comprises sensitive elements located on a plane where an image of the security document forms, the sensitive elements picking up the formed image of the security document, said path comprises a lens (21) which focuses the light source onto a focal point (F), through which said security document is made to pass as a target, along the optical path at or upstream of said lens (21), shading means (22) is provided apt to define a cone of shade (5) in correspondence on the sensitive elements of said camera (5).

4. Inspecting system as in claim 3, wherein said shading means (5) is a semitransparent material layer due to which, in the absence of a target to be inspected, said camera (5) does not exceed the saturation threshold which would otherwise corrupt the quality of the image.

5. Inspecting system as in claim 4, wherein said semitransparent material is easily replaceable.

6. Inspecting system as in claim 4, wherein said semitransparent material, in the absence of a target, allows the camera at most to reach but not exceed the saturation threshold.

7. Inspecting system as in claim 3, wherein said shading means is so transparent and sized as not to absorb more than 10% of the light intensity hitting the target.

8. Inspecting system as in claim 3, wherein said illuminating device has reflecting surfaces at its side ends.

9. Inspecting system as in claim 5, wherein said semitransparent material, in the absence of a target, allows the camera at most to reach but not exceed the saturation threshold.

10. Inspecting system for security documents, comprising:

a transportation device comprised of a rotating cylinder (10) provided with transparent sectors (10*a*, 10*b*) of a size at least equal to a size of a portion of a security document to be inspected; and a transparency inspecting device comprised of i) an image acquiring device, ii) an illuminating device (3), and iii) an electromagnetic inspecting beam arranged between the image acquiring device and the illuminating device, the transportation device comprising elements to transport said security document past the image acquiring device, said transparency inspecting device located partially inside and partially outside the cylinder so that the electromagnetic inspecting beam is intercepted by said security document held lying onto said transparent sectors, said transportation cylinder comprising a gripping system for said security document, said gripping system having a pivoting gripping element (11) cooperating with at least a radially movable block (12), the gripping point of the security document able to be lowered relative to the nominal rotational diameter thereof so as not to interfere with calibration blades (13) fixedly placed in proximity of the inspection axis and adjacent to said rotating cylinder, and said transparent sectors covered, on the security document bearing side, by a removable transparent protective layer.

11. Inspecting system for security documents, comprising:

a transportation device comprised of a rotating cylinder (10) provided with transparent sectors (10*a*, 10*b*) of a size at least equal to a size of a portion of a security document to be inspected;

a transparency inspecting device comprised of i) an image acquiring device, ii) an illuminating device (3), and iii) an electromagnetic inspecting beam arranged between the image acquiring device and the illuminating device, the transportation device comprising elements to transport said security document past the image acquiring device, wherein, said transparency inspecting device is located partially inside and partially outside the cylinder with the electromagnetic inspecting beam intercepted by said security document held lying onto said transparent sectors, said transportation cylinder comprises a gripping system for said security document, said gripping system having a pivoting gripping element (11) cooperating with at least a radially movable block (12), the gripping point of the security document is able to be lowered relative to the nominal rotational diameter thereof so as not to interfere with calibration blades (13) fixedly placed in proximity of the inspection axis and adjacent to said rotating cylinder, an optical path is defined between the illuminating device (3) and an acquisition camera, the acquisition camera comprises sensitive elements located on a plane where an image of the security document forms, the sensitive elements picking up the formed image of the security document, said path comprises a lens (21) which focuses the light source onto a focal point (F), through which focal point said security document is made to pass as a target, along the optical path at or upstream of said lens (21), shading means (22) is provided to define a cone of shade (5) on the sensitive elements of said camera (5), and wherein said shading means (5) is a semitransparent material layer due to which, in the absence of a target to be inspected, said camera (5) does not exceed the saturation threshold which would otherwise corrupt the quality of the image.

12. Inspecting system as in claim 11, wherein said semitransparent material is replaceable.

13. Inspecting system as in claim 11, wherein said semitransparent material, in the absence of a target, allows the camera at most to reach but not exceed the saturation threshold.

14. Inspecting system as in claim 11, wherein said shading means is so transparent and sized as not to absorb more than 10% of the light intensity hitting the target.

15. Inspecting system as in claim 11, wherein said illuminating device has reflecting surfaces at its side ends.

* * * * *